US008474423B2

(12) United States Patent
Hayashi

(10) Patent No.: US 8,474,423 B2
(45) Date of Patent: Jul. 2, 2013

(54) VALVE TIMING CONTROL DEVICE

(75) Inventor: Masashi Hayashi, Okazaki (JP)

(73) Assignee: Denso Corporation, Kariya (JP)

( * ) Notice: Subject to any disclaimer, the term of this patent is extended or adjusted under 35 U.S.C. 154(b) by 46 days.

(21) Appl. No.: 13/338,669

(22) Filed: Dec. 28, 2011

(65) Prior Publication Data

US 2012/0180740 A1 Jul. 19, 2012

(30) Foreign Application Priority Data

Jan. 14, 2011 (JP) ..... 2011-5752

(51) Int. Cl.
*F01L 1/34* (2006.01)

(52) U.S. Cl.
USPC ..... 123/90.17

(58) Field of Classification Search
USPC ..... 123/90.15, 90.17; 464/160, 161
See application file for complete search history.

(56) References Cited

U.S. PATENT DOCUMENTS 7,198,013 B2 * 4/2007 Palesch et al. ..... 123/90.17

FOREIGN PATENT DOCUMENTS

| | | |
|---|---|---|
| JP | 11-62524 | 3/1999 |
| JP | 3567551 | 6/2004 |
| JP | P2012-132427 A | 7/2012 |

* cited by examiner

*Primary Examiner* — Thomas Denion
*Assistant Examiner* — Daniel Bernstein
(74) *Attorney, Agent, or Firm* — Nixon & Vanderhye PC

(57) ABSTRACT

A valve timing control device includes a first housing, a vane rotor, a second housing, a sealing plate, a regulating portion and a biasing portion. The sealing plate is interposed between the first housing and the second housing. The biasing portion biases the regulating portion toward the sealing plate. The sealing plate has a recess recessed from a base part toward the second housing at a predetermined position corresponding to the regulating portion in a relative rotation of the vane rotor. The regulating portion regulates the relative rotation of the vane rotor relative to the first housing and the second housing by being fitted with the recess of the sealing plate.

5 Claims, 8 Drawing Sheets

VALVE TIMING CONTROL DEVICE

CROSS REFERENCE TO RELATED APPLICATION

This application is based on Japanese Patent Application No. 2011-5752 filed on Jan. 14, 2011, the disclosure of which is incorporated herein by reference in its entirety.

BACKGROUND OF THE INVENTION

1. Field of the Invention

The present invention relates to a valve timing control device.

2. Description of Related Art

A vane-type valve timing control device is known in which a camshaft is driven by a crankshaft of an internal combustion engine via a timing pulley synchronously rotated with the crankshaft and a chain sprocket. At least one of an intake valve and an exhaust valve is opened/closed with a phase difference based on a relative rotation between the camshaft and the timing pulley or the chain sprocket. In the vane-type valve timing control device, a vane rotor having vanes is rotatably accommodated in a housing member, so that axial end surfaces of the vane rotor are in a sliding contact with respective inner surfaces of the housing member. An advancing oil chamber is formed on one side of the vane in a rotational direction, while a retarding oil chamber is formed on the other side of the vane in the rotational direction.

When a sliding clearance between the vane rotor and the housing member is large, a part of working fluid may get out from the advancing oil chamber to the retarding oil chamber, or vice versa. This phenomenon is called as an internal leakage. When the internal leakage occurs, oil pressure from an oil pump cannot be effectively used for controlling the valve timing. As a result, energy efficiency may be decreased and accuracy for phase control by valve opening/closing timing may be decreased.

The sliding clearance includes a radial clearance between an outer periphery of the vane rotor and an inner periphery of the housing member and a thrust clearance between the axial end surfaces of the vane rotor and the inner surfaces of the housing member. A seal member and a plate spring have been used in the art for suppressing the internal leakage via the radial clearance.

In contrast, as an art for suppressing the internal leakage via the thrust clearance, in a valve timing control device described in JP 3567551B2, a sealing plate having a convex elastic member contacts an end face of a vane rotor, so as to restrict the internal leakage.

A valve timing control device may further include a stopper pin corresponding to a regulating portion that regulates a relative rotation between a vane rotor and a housing member at a most advanced position or a most retarded position. When a predetermined oil pressure is not supplied to the valve timing control device such as an engine starting timing, the stopper pin regulates the relative rotation between the vane rotor and the housing member even when a cam torque is generated by a rotation of a camshaft.

FIG. 4 of JP 3567551 B2 illustrates a structure that a tip end of the stopper pin is fitted into a stopper hole defined in a front plate. In such valve timing control device having the sealing plate, it is necessary that a fitting hole is provided on the opposite side of the sealing plate and that the tip end of the stopper pin is fitted into the fitting hole. Alternatively, an escape hole into which the tip end of the stopper pin passes may be defined in the sealing plate, and a fitting hole may be defined on the opposite side of the sealing plate relative to the stopper pin. In both cases, the fitting hole is necessary to be defined in a member other than the sealing plate, so that the number of components and the number of manufacturing processes are increased.

SUMMARY OF THE INVENTION

According to a feature of the invention, a valve timing control device that controls a valve opening/closing timing of at least one of an intake valve and an exhaust valve of an engine by changing a phase between a driving shaft of the engine and a driven shaft driven by the driving shaft so as to open/close the intake valve and the exhaust valve includes a cup-shaped first housing, a vane rotor, a second housing, a sealing plate, a regulating portion and a biasing portion. The cup-shaped first housing is rotated together with one of the driving shaft and the driven shaft, and has an opening on an end face in an axis direction of the one of the driving shaft and the driven shaft. The vane rotor is accommodated in the first housing and rotated together with the other of the driving shaft and the driven shaft. The vane rotor has multiple vane portions rotatable relative to the first housing within a predetermined angular range. Multiple advancing oil chambers are formed at one side of the respective vane portion in a rotational direction thereof, and multiple retarding oil chambers are formed at the other side of the respective vane portion in the rotational direction thereof. The second housing is fixed to the first housing so as to close the opening of the first housing. The sealing plate is interposed between the first housing and the second housing, and has a resiliently projected portion that is elastically deformable in a thickness direction and in contact with an end face of the vane rotor. The regulating portion is reciprocably accommodated in an accommodation hole opened in the vane rotor so as to oppose to the sealing plate. The biasing portion biases the regulating portion toward the sealing plate. The sealing plate has a recess recessed toward the second housing and opened to the vane rotor at a predetermined position corresponding to the regulating portion in the relative rotation of the vane rotor. The regulating portion regulates the relative rotation of the vane rotor relative to the first housing and the second housing by being fitted with the recess of the sealing plate.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

Figure 1:
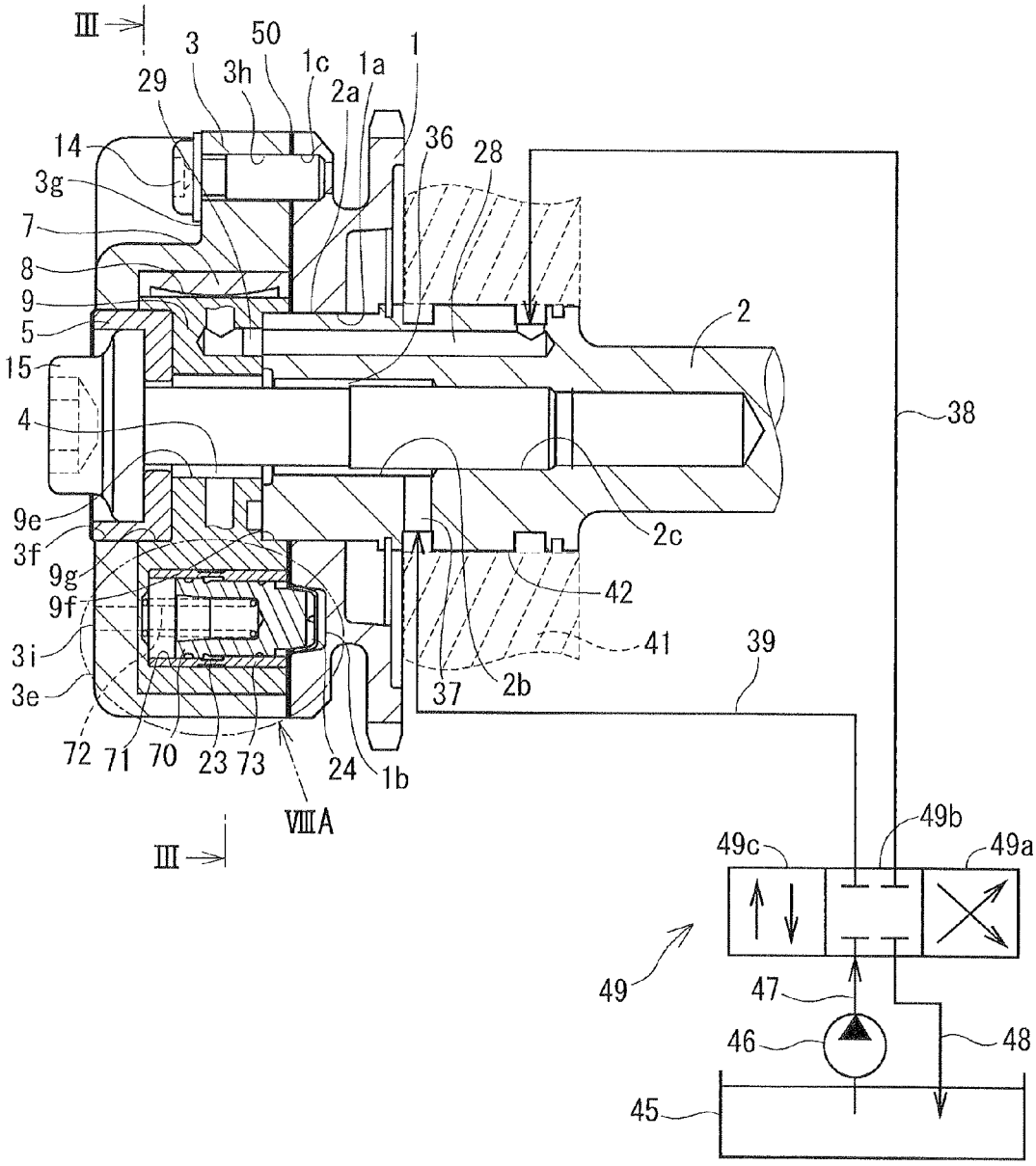
FIG. 1 is a schematic cross-sectional view showing a valve timing control device according to a first embodiment of the present invention.
Figure 2:
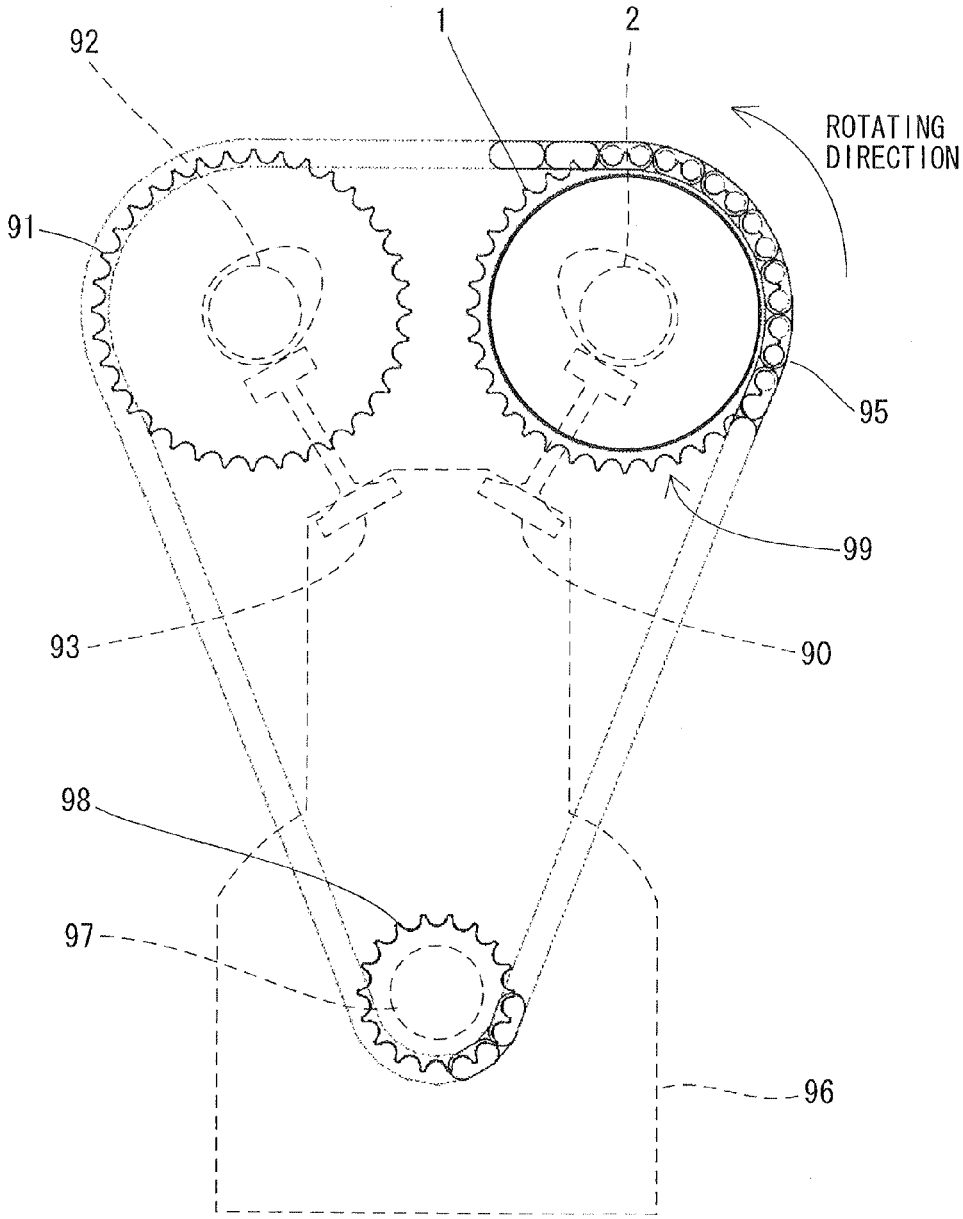
FIG. 2 is a schematic view showing an internal combustion engine, to which the valve timing control device is applied.

A first embodiment of the present invention will be explained hereinafter with reference to FIGS. 1 to 8A. As shown in FIG. 2, a valve timing control device 99 is applied to an intake valve 90 of an internal combustion engine 96, and opens or closes the intake valve 90 with a phase difference relative to a crankshaft 97.

A sprocket 1 is coaxially arranged with a camshaft 2. A gear 91 for an exhaust valve 93 is coaxially arranged with a camshaft 92. A driving gear 98 is coaxially arranged with the crankshaft 97. The camshaft 2 opens and closes the intake valve 90, while the camshaft 92 opens and closes the exhaust valve 93. A chain 95 is engaged with the sprocket 1, the gear 91 for the exhaust valve 93 and the driving gear 98, so as to transmit a driving force of the crankshaft 97 to the sprocket 1 and the gear 91 for the exhaust valve 93 so that those gears are rotated in a synchronized manner with each other.

The crankshaft 97 may correspond to a driving shaft, and the camshaft 2 for the intake valve 90 may correspond to a driven shaft.

An outline of a structure for the valve timing control device 99 will be explained with reference to FIGS. 1 to 6.

Figure 3:
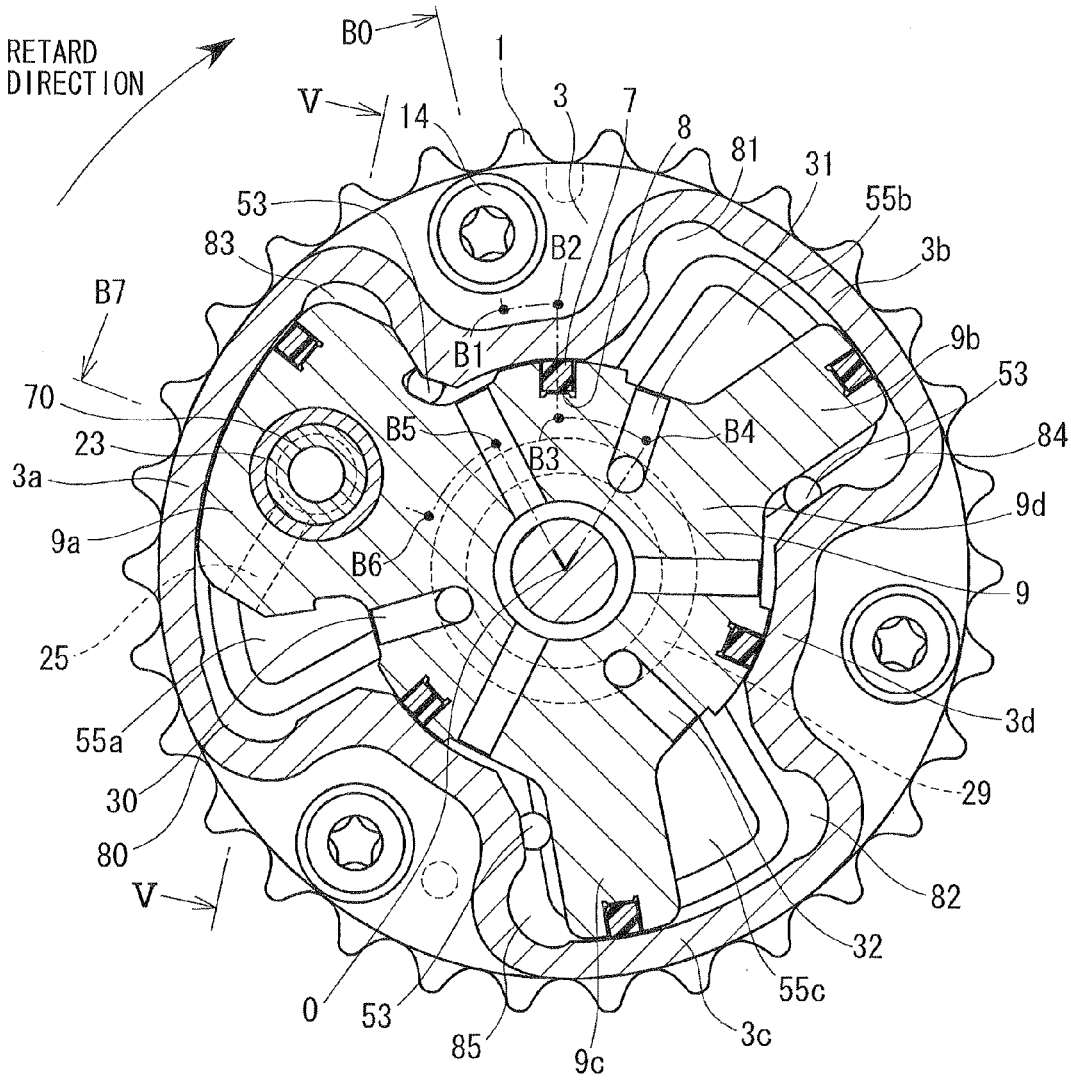
FIG. 3 is a schematic cross-sectional view taken along a line III-III in FIG. 1, in which a most retarded position of the valve timing control device is shown.
Figure 4:
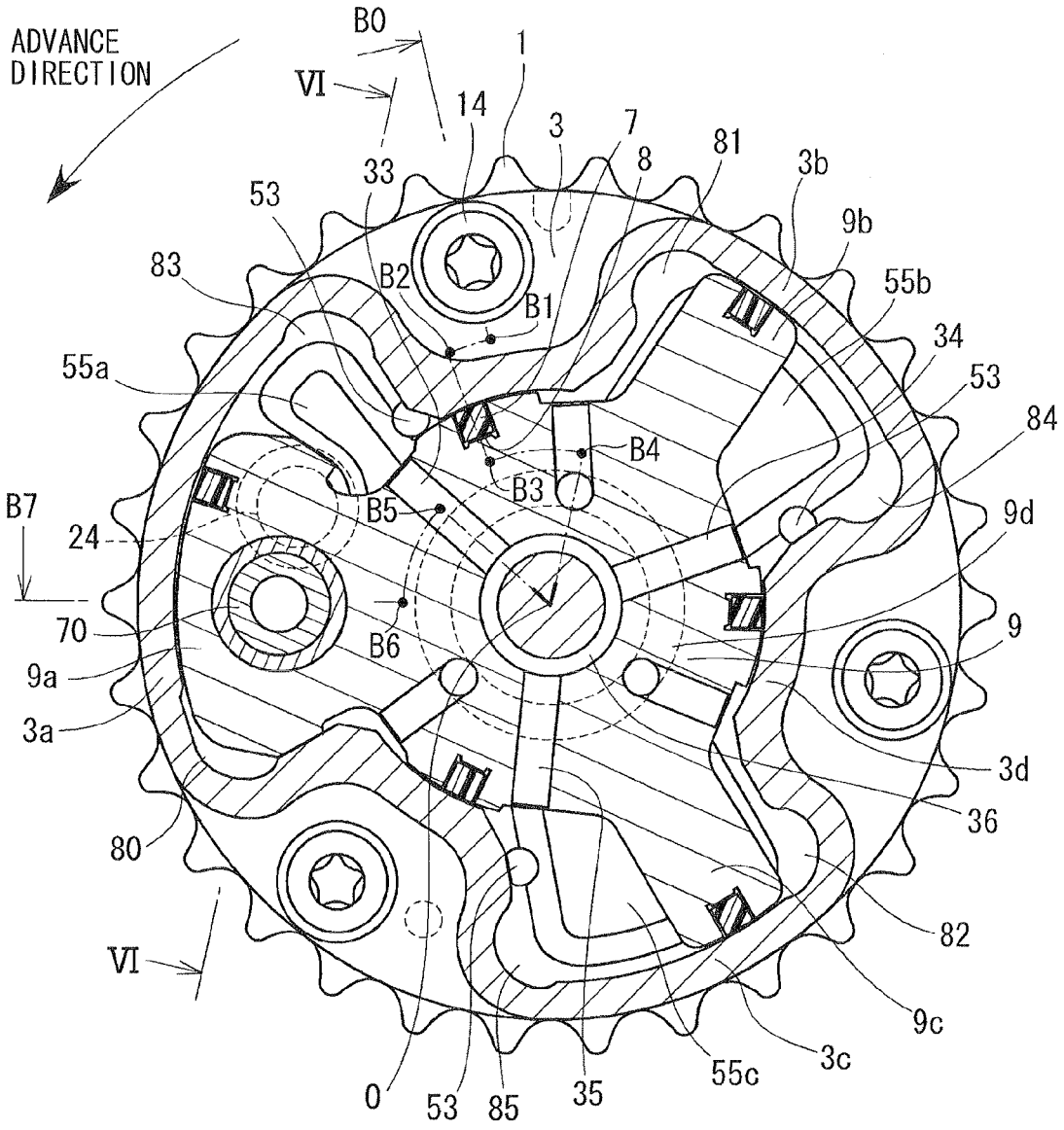
FIG. 4 is a schematic cross-sectional view corresponding to FIG. 3, in which a most advanced position of the valve timing control device is shown.

According to the valve timing control device 99, a valve timing is controlled by changing relative rotational position of a vane rotor 9 with respect to a housing member (including the sprocket 1 and a shoe housing 3). In this specification, "advancing" means "advancing the valve timing", while "retarding" means "retarding the valve timing". In FIGS. 3 and 4, a counter clockwise direction is "an advancing direction", while a clockwise direction is "a retarding direction". A side of advancing the valve timing is referred to as an advancing side, while a side of retarding the valve timing is referred to as a retarding side.

An upper limit of "a predetermined angular range", in which the vane rotor 9 is rotated relative to the housing member (the sprocket 1 and the shoe housing 3), is referred to as a maximum advanced position. A lower limit of "the predetermined angular range" is referred to as a maximum retarded position. FIG. 3 is a cross sectional view showing a condition, in which a stopper pin 70 is fitted with a recess 60 in the maximum retarded position. FIG. 4 is a cross sectional view showing a condition, in which the stopper pin 70 is out of the recess 60 in the maximum advanced position. FIG. 1 is a cross sectional view taken along a line B0-B1-B2-B3-B4-O-B5-B6-B7 in FIG. 3.

The structure of the valve timing control device 99 will be explained. In the following explanation, a right-hand side in FIG. 1 is referred to as a back side and a left-hand side is referred to as a front side.

The shoe housing 3 and the sprocket 1 are also referred to as a first housing member and a second housing member, respectively.

The sprocket 1 is rotated when the driving force is transmitted from the crankshaft 97. The sprocket 1 has a bearing hole 1*a* at a center thereof, into which the camshaft 2 is inserted. The sprocket 1 has an accommodation hole 1*b* with a bottom at a position corresponding to the stopper pin 70 at the maximum retarded position. The sprocket 1 further has a tap hole 1*c* into which a screw 14 is inserted.

The shoe housing 3 is formed in a cup shape having an open end on a side to the sprocket 1. A front side end of the shoe housing 3 is closed. An accommodating chamber 4 is formed in the shoe housing 3. The accommodating chamber 4 is a space surrounded by a front portion 3*e*, shoe portions 3*a*, 3*b* and 3*c*, and center wall portions 3*d*. Each of the shoe portions 3*a*, 3*b* and 3*c* is expanded from the center wall portions 3*d* in a radial outward direction.

Three center wall portions 3*d* are formed respectively between neighboring shoe portions 3*a*, 3*b* and 3*c* in a circumferential direction. A cross section of each center wall portion 3*d* is formed in an arc shape, so as to correspond to a shape of a rotor body 9*d* of the vane rotor 9.

A cross section of an inner wall of each shoe portion 3*a*, 3*b* and 3*c* is also formed in an arc shape. A wall of each shoe portion 3*a*, 3*b* and 3*c* on the advancing side as well as a wall of each shoe portion 3*a*, 3*b* and 3*c* on the retarding side is connected to the respective center wall portion 3*d*. Each of the shoe portions 3*a*, 3*b* and 3*c* accommodates respective vane portion 9*a*, 9*b* and 9*c*. A width of the vane portion 9*a* in the circumferential direction is larger than that of the other vane portions 9*b* and 9*c*. Only a side surface of the vane portion 9*a* on the retarding side is brought into contact with an inner wall of the shoe portion 3*a* on the retarding side, when the vane rotor 9 is in the maximum retarded position. In a similar manner, only a side surface of the vane portion 9*a* on the advancing side is brought into contact with an inner wall of the shoe portion 3*a* on the advancing side, when the vane rotor 9 is in the maximum advanced position. In contrast, neither side surfaces of the vane portions 9*b* and 9*c* on the retarding side nor side surfaces of the vane portions 9*b* and 9*c* on the advancing side are brought into contact with inner walls of the shoe portions 3*b* and 3*c*, when the vane rotor 9 is in the maximum retarded or advanced position.

The front portion 3*e* is provided at the front side of the accommodating chamber 4. A center through-hole 3*f* is formed at a center of the front portion 3*e*. Three flanged portions 3*g* are formed between the respective neighboring shoe portions 3*a*, 3*b* and 3*c* in the circumferential direction of the shoe housing 3, so that the flanged portions 3*g* surround the front portion 3*e*. A screw hole 3*h* is formed in each of the flanged portions 3*g*.

A through-hole 3*i* opened to the air is formed in the front portion 3*e* at a position corresponding to the stopper pin 70 in the maximum retarded position.

Figure 7A:
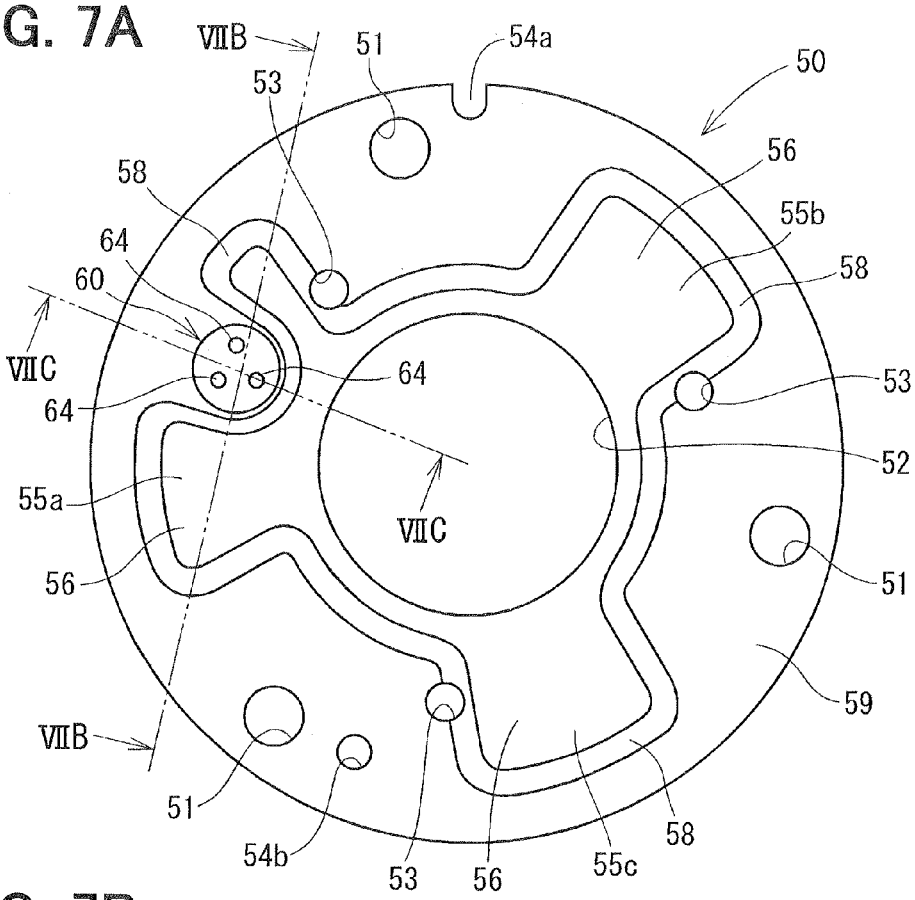
FIG. 7A is a schematic plan view showing a sealing plate of the valve timing control device.

Positioning holes indicated by a dotted line in FIGS. 3 and 4 are formed in each of the sprocket 1 and the shoe housing 3 at such corresponding positions to each other. As shown in FIG. 7A, a positioning notch 54*a* as well as a positioning hole 54*b* is formed in a sealing plate 50 at such respective corresponding positions.

The sealing plate 50 is interposed between the sprocket 1 and the shoe housing 3. The sealing plate 50 and the shoe housing 3 are positioned to the sprocket 1 by a knock pin (not shown), and three screws 14 are inserted into the respective screw holes 3*h* and screwed to the tap holes 1*c*, so that the shoe housing 3 is coaxially fixed to the sprocket 1.

The vane rotor 9 is accommodated in the accommodating chamber 4 and composed of the vane portions 9*a*, 9*b* and 9*c* and the rotor body 9*d*. The rotor body 9*d* faces to the center wall portions 3*d* of the shoe housing 3, while each of the vane portions 9*a*, 9*b* and 9*c* respectively faces to the shoe portions 3*a*, 3*b* and 3*c*. When the vane rotor 9 is rotated relative to the shoe housing 3, the following three pairs (a) to (c) of the retarding oil chamber and the advancing oil chamber are formed:

(a) In a space surrounded by the shoe portion 3*a*, the vane portion 9*a* and the rotor body 9*d*, a retarding oil chamber 80 is formed on the advancing side of the vane portion 9*a*, while an advancing oil chamber 83 is formed on the retarding side of the vane portion 9*a*.

(b) In a space surrounded by the shoe portion 3*b*, the vane portion 9*b* and the rotor body 9*d*, a retarding oil chamber 81 is formed on the advancing side of the vane portion 9*b*, while an advancing oil chamber 84 is formed on the retarding side of the vane portion 9*b*.

(c) In a space surrounded by the shoe portion 3*c*, the vane portion 9*c* and the rotor body 9*d*, a retarding oil chamber 82 is formed on the advancing side of the vane portion 9*c*, while an advancing oil chamber 85 is formed on the retarding side of the vane portion 9*c*.

The retarding oil chambers 80, 81 and 82 as well as the advancing oil chambers 83, 84 and 85 are respectively defined by the vane portions 9*a*, 9*b* and 9*c* as well as the rotor body 9*d*.

A seal element 7 and a plate spring 8 are provided in a sealing groove formed at an outer peripheral wall of the rotor body 9*d* and an outer peripheral wall of each vane portion 9*a*, 9*b* and 9*c*. The seal element 7 is biased to the inner peripheral surface of the shoe housing 3 by the plate spring 8 in a radial outward direction in order to suppress the internal leakage via the radial clearance. A sealing structure for suppressing the internal leakage via the thrust clearance will be explained below.

The vane rotor 9 has a through-hole 9*e* at a center thereof. A press-fit portion 9*f* at a back end of the through-hole 9*e* and a press-fit portion 9*g* at a front end of the through-hole 9*e* are precisely manufactured in terms of coaxial accuracy.

A forward end 2*a* of the camshaft 2 is press-inserted into the press-fit portion 9*f*, and an outer wall of the forward end 2*a* is fitted with an inner wall of the press-fit portion 9*f*. A flatness of a bottom surface of the press-fit portion 9*f* as well as a perpendicularity of the bottom surface with respect to an axial line is precisely controlled. As a result, the surface of the forward end 2*a* of the camshaft 2 is accurately brought into contact with the bottom surface of the press-fit portion 9*f*, so that oil leakage through a surface-to-surface contacting portion between the camshaft 2 and the vane rotor 9 can be prevented.

A center washer 5 is press-inserted into the press-fit portion 9*g* at the front end of the through-hole 9*e*, and an outer wall of the center washer 5 is fitted with an inner wall of the press-fit portion 9*g*. A flatness of a bottom surface of the press-fit portion 9*g* as well as a perpendicularity of the bottom surface with respect to the axial line is precisely controlled. As a result, a forward end surface of the center washer 5 is accurately brought into contact with the bottom surface of the press-fit portion 9*g*, so that oil leakage through a surface-to-surface contacting portion between the center washer 5 and the vane rotor 9 can be prevented.

An oil-passage bore 2*b* is formed in a center of the camshaft 2 on the front side thereof, so that the oil-passage bore 2*b* is connected to the through-hole 9*e* of the vane rotor 9. An oil inlet port 37 is opened at a side surface of the oil-passage bore 2*b*. An oil inlet passage 28 is formed in the camshaft 2 extending in the axial direction from the forward end surface of the camshaft 2. A tap hole 2*c* is formed at a bottom side of the oil-passage bore 2*b*, into which a center bolt 15 is screwed.

A recessed portion is formed in the center washer 5 on its front side, which is an opposite side to the vane rotor 9. A through-hole is formed in a bottom wall of the recessed portion.

The center bolt 15 passes through the through-hole of the center washer 5, the through-hole 9*e* of the vane rotor 9 and the oil-passage bore 2*b* of the camshaft 2. The center bolt 15 is screwed into the tap hole 2*c* with a predetermined tightening torque. At this time, a flanged surface of a bolt head of the center bolt 15 is brought into contact with the bottom surface of the recessed portion of the center washer 5. A loosening of the center bolt 15 is prevented by a friction between the flanged surface and the bottom surface. As above, the vane rotor 9 is firmly and coaxially fixed to the camshaft 2.

A sealing structure for suppressing the internal leakage via the thrust clearance will be explained.

For the shoe housing 3, a parallelism of a depth "Ds" between the end surface and an inner bottom surface of the accommodating chamber 4 is precisely processed. For the vane rotor 9, a parallelism of a thickness "Tv" between the end surfaces is precisely controlled.

The depth "Ds" of the accommodating chamber 4 is set slightly larger than the thickness "Tv" of the vane rotor 9. In addition, a value, which is calculated by subtracting the thickness "Tv" from the depth "Ds", is called here a thrust clearance "Ct".

$$Ct=Ds-Tv \quad \text{(formula 1)}$$

FIG. 7A shows a plan view of the sealing plate 50, when viewed in a direction from the side of the vane rotor 9.

The sealing plate 50 is produced by press working a steel sheet, for example.

A through-hole 52, through which the forward end 2*a* of the camshaft 2 is inserted, is formed at a center of the sealing plate 50. Three through-holes 51, through which the screws 14 are inserted, are formed in the sealing plate 50 so as to correspond to the tap hole 1*c* of the sprocket 1 and the screw hole 3*h* of the shoe housing 3. The positioning notch 54*a* and the positioning hole 54*b* are also formed in the sealing plate 50. Hereinafter, the above through-holes 52, 51 and the hole 54*b* as well as the notch 54*a* are also collectively referred to as respective holes of the sealing plate 50. The sealing plate 50 is interposed between the shoe housing 3 and the sprocket 1 by use of the respective holes of the sealing plate 50.

Three resiliently projected portions 55*a*, 55*b* and 55*c* of almost a fan shape are respectively formed in the sealing plate 50 around the through-hole 52 at such areas corresponding to the relative rotation range of the vane portions 9*a*, 9*b* and 9*c*. "Projected" means here "projected in a direction endways from a sheet of FIG. 7A. Three resiliently projected portions 55*a*, 55*b* and 5*c* are also collectively referred to as a resiliently projected portion 55. The resiliently projected portion 55 is elastically deformable in a thickness direction.

A portion of the sealing plate 50 except for the resiliently projected portion 55 and the respective holes of the sealing plate 50 forms a base part 59. The base part 59 is also referred to as a flanged portion or reference surface portion, which is interposed between the shoe housing 3 and the sprocket 1.

Figure 5:
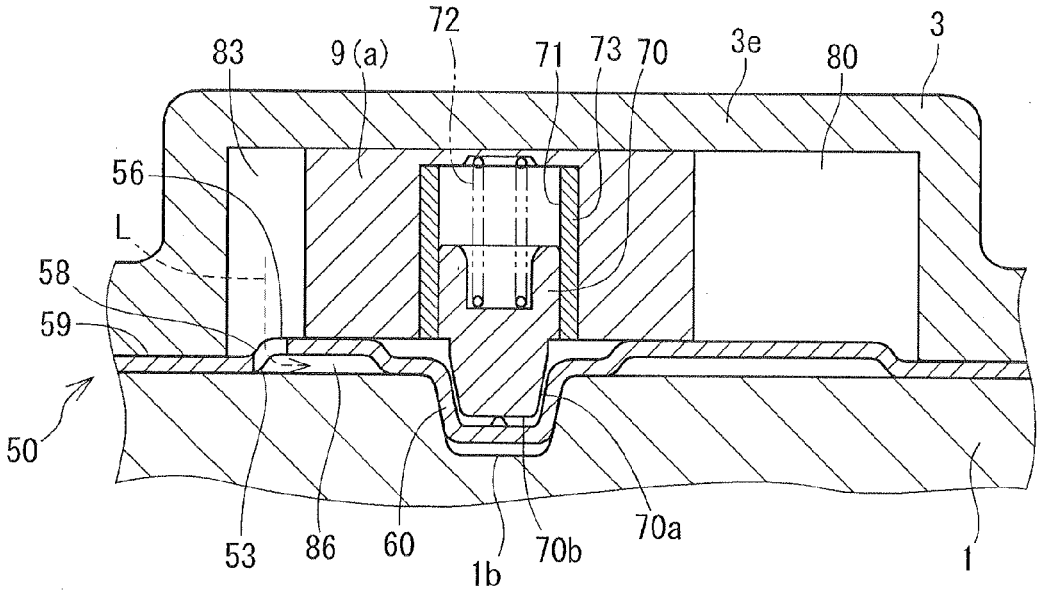
FIG. 5 is a schematic enlarged cross-sectional view taken along a line V-V in FIG. 3.
Figure 6:
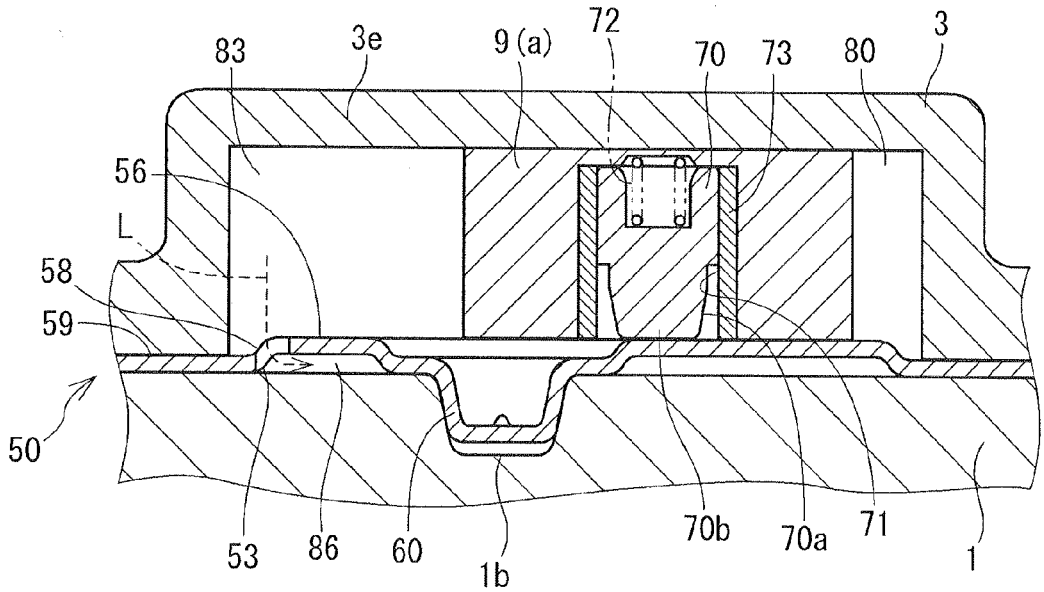
FIG. 6 is a schematic enlarged cross-sectional view taken along a line VI-VI in FIG. 4.

In FIGS. 5, 6, 7B and 7C, dimension of the sealing plate 50 in the thickness direction is shown in an exaggerated form. In FIGS. 5 and 6, the cross section of the shoe portion 3*a* is shown as a representative example for the shoe portions 3*a*, 3*b* and 3*c*.

Figure 7B:
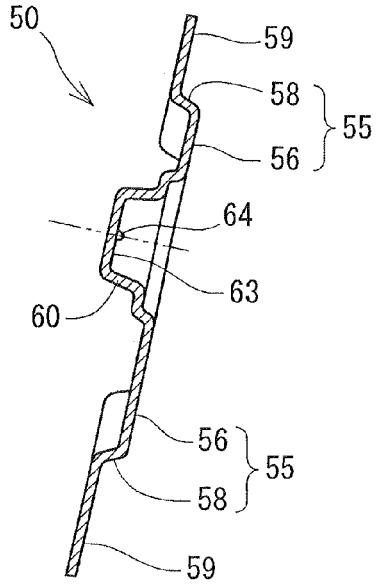
FIG. 7B is a cross-sectional view taken along a line VIIB-VIIB in FIG. 7A.

As shown in FIG. 7B, the resiliently projected portion 55 is composed of an inclined surface portion 58 and a projected surface portion 56. The projected surface portion 56 is formed in a flat surface portion and brought into contact with the vane rotor 9. The inclined surface portion 58 is formed at an outer periphery of the projected surface portion 56 and gradually inclined toward the base part 59 so as to gradually reduce a vertical interval between the projected surface portion 56 and the base part 59 (that is, a distance in the axial direction to the base part 59). A space surrounded by the resiliently projected portion 55, the axial end surface of the sprocket 1 and the outer peripheral surface of the forward end 2*a* of the camshaft 2 forms a pressure chamber 86.

The vertical interval between the projected surface portion 56 and the base part 59 in a condition of a single part of the sealing plate 50, that is, a free height "He" is set to be larger than the thrust clearance "Ct". A difference between the free height "He" and the thrust clearance "Ct" is represented by a deflection "δ" which can be expressed in the following formula 2.

$$\delta = He - Ct > 0 \quad \text{(formula 2)}$$

Since the deflection "δ" is larger than "0" (zero), the resiliently projected portion 55 is compressed in the assembled state so as to contact the end face of the vane rotor 9, thereby achieving sealing effect for the internal leakage by the elastic force.

The sealing plate 50 has three oil-passage apertures 53. As shown in FIG. 3, each of the oil-passage apertures 53 is provided at such a position, at which the oil-passage aperture 53 is in communication with the respective advancing oil chambers 83, 84 and 85 in the maximum retarded position. In other words, each of the oil-passage apertures 53 is formed in the sealing plate 50 at a side end of the retarding side of the respective resiliently projected portions 55*a*, 55*b* and 55*c*. More in detail, as shown in FIGS. 5 and 6, each of the oil-passage apertures 53 is formed astride over the inclined surface portion 58 and the base part 59. As a result, the oil pressure of the advancing oil chambers 83, 84 and 85 is continuously applied to the pressure chamber 86 via the respective oil-passage apertures 53, even when the vane rotor 9 is moved from the maximum advanced position to the maximum retarded position. Thus, due to the pressure difference generated between the top side and the back side of the sealing plate 50, the sealing plate 50 is pressed toward the vane rotor 9, thereby further raising the sealing effect for the internal leakage.

In this situation, since the oil pressure in the pressure chamber 86 is higher than the oil pressure in the retarding oil chambers 80, 81 and 82, which are on the opposite side of the resiliently projected portion 55, a pressure difference is generated between the front and back sides of the resiliently projected portion 55. In addition, since the resiliently projected portion 55 of the almost fan shape is large in size in the circumferential direction and in the radial direction, namely an area of the resiliently projected portion 55 is large, the oil pressure in the pressure chamber 86 is applied to the resiliently projected portion 55 in such large area. As a result, a large pushing load can be generated.

The sealing plate 50 integrally has a recess 60 at a position corresponding to the position of the stopper pin 70 in the maximum retarded position (FIGS. 3 and 5). The recess 60 opens to the vane rotor 9, and is recessed toward the sprocket 1. The resiliently projected portion 55 is formed to avoid the recess 60.

Figure 7C:
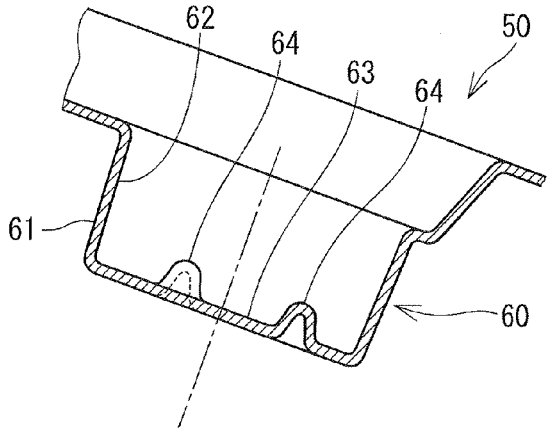
FIG. 7C is a cross-sectional view taken along a line VIIC-VIIC in FIG. 7A.

As shown in FIGS. 7A-7C, a bottom wall 63 of the recess 60 has three projections 64 projected toward the vane rotor 9. The three projections 64 are arranged to be distanced from a center of the bottom wall 63 by an approximately uniform distance. Heights of the three projections 64 are approximately the same, and are small enough compared with the depth of the recess 60.

The sealing plate 50 is formed into the above-described shape through the press working, for example, then, heat treatment and surface treatment are performed so that the sealing plate 50 has the Rockwell hardness (HRc) of 50 or more as measured by a C-scale. Specifically, high-frequency hardening, carbonitriding treatment, titanium nitride (TiN) coating, tungsten carbide (WC) coating, diamond-like carbon (DLC) coating, or hard chrome treatment is performed, for example. Alternatively, ultrahard material may be used for producing the sealing plate 50 in place of the above treatment, if a predetermined toughness is obtained in the shaping process.

A structure for a stopper mechanism will be explained with reference to FIG. 8A.

The stopper pin 70 corresponding to a regulating portion is movably inserted into an accommodation hole 71 with a bottom wall. The hole 71 is formed in the vane portion 9*a* on the axial side facing to the sprocket 1. The bottom of the hole 71 has a through-hole, which is brought into communication with the through-hole 3*i* formed in the front portion 3*e* and opened to the air when the vane rotor 9 is in the maximum retarded position.

An inner wall of the accommodation hole 1*b* of the sprocket 1 is formed in a tapered shape, so that an inner diameter of the hole 1*b* is deceased toward its bottom end. An outer wall 61 of the recess 60 of the sealing plate 50 is almost tightly fitted with the accommodation hole 1*b*. Thus, the recess 66 is backed-up or supported by the accommodation hole 1*b*.

In contrast, the stopper pin 70 has a fitting part 70*a* on an outer wall of tip end of the stopper pin 70, and the fitting part 70*a* is formed slightly smaller than an inner wall 62 of the recess 60. A ring-shaped clearance 26 is defined between the inner wall 62 of the recess 60 and the fitting part 70*a* of the stopper pin 70 when the stopper pin 70 is fitted with the recess 60. A space surrounded by a tip end face 70*b* of the stopper pin 70 and the inner wall 62 and the bottom wall 63 of the recess 60 is defined as an oil pressure chamber 24.

When the fitting part 70*a* of the stopper pin 70 is fitted with the inner wall 62 of the recess 60, the tip end face 70*b* of the stopper pin 70 contacts the projection 64. Therefore, the tip end face 70*b* of the stopper pin 70 is restricted from adhering on the bottom wall 63 in a state where the stopper pin 70 is biased by a spring 72. Further, the oil pressure chamber 24 can be secured to have a predetermined height corresponding to the height of the projection 64.

The spring 72 is provided between the bottom wall of the hole 71 and the stopper pin 70, and biases the stopper pin 70 toward the recess 60.

A guiding bush 73 is firmly inserted into the hole 71 and a part of an outer peripheral surface of the stopper pin 70 is movably supported by an inner peripheral surface of the guiding bush 73, so that an axial movement of the stopper pin 70 is guided by the guiding bush 73.

A pressure receiving groove is formed at a longitudinally intermediate portion of the stopper pin 70. A space defined between the groove and the inner wall of the guiding bush 73 works as a oil pressure chamber 23. A communication port 25 is formed at a side portion of the guiding bush 73 for supplying working oil from a retarding oil passage 38 into the oil chamber 23.

According to the above structure, when the oil pressure is applied to either the oil chamber 23 or the oil chamber 24, the stopper pin 70 is moved toward the bottom wall of the hole 71 against the biasing force of the spring 72 (that is, leftward in FIG. 8A), and the stopper pin 70 is moved out of the recess 60. In this movement of the stopper pin 70, air in the hole 71 is released into the air via the through-hole 3*i* opened to the air.

As shown in FIG. 3, in the maximum retarded position of the vane rotor 9, since the stopper pin 70 is inserted into the recess 60, the vane rotor 9 is fixed to the sprocket 1 and rotated thereby together with the sprocket 1. Namely, the vane rotor 9 is not rotated relative to the sprocket 1.

When the stopper pin 70 comes out of the recess 60, the coupling between the vane rotor 9 and the sprocket 1 is released, so that the vane rotor 9 is movable relative to the sprocket 1 in the angular range from the maximum retarded position to the maximum advanced position.

A structure for supplying and draining the working oil will be explained.

An annular oil-passage portion 29 is formed at a bottom of the press-fit portion 9*f* of the rotor body 9*d*. The annular oil-passage portion 29 is in contact with the forward end surface of the camshaft 2 and communicated to the retarding oil passage 38 via the oil inlet passage 28 formed in the camshaft 2. The annular oil-passage portion 29 is further communicated to three retarding branch-put passages 30, 31 and 32 in the rotor body 9*d*. The retarding branch-out passage 30 is communicated to the retarding oil chamber 80, the retarding branch-out passage 31 is communicated to the retarding oil chamber 81 and the retarding branch-out passage 32 is communicated to the retarding oil chamber 82.

Oil passages, which may respectively connect the oil inlet passage 28 to each of the retarding branch-out passages 30, 31 and 32, may be provided instead of the annular oil-passage portion 29.

A center oil passage 36 is formed in a space formed in the through-hole 9*e* of the vane rotor 9 and the oil-passage bore 2*b* of the camshaft 2 at an outer periphery of a shaft portion of the center bolt 15. The center oil passage 36 is communicated to the advancing oil passage 39 via the oil inlet port 37 opening to the oil-passage bore 2*b* of the camshaft 2. The center oil passage 36 is further communicated to advancing branch-out passages 33, 34 and 35 in the rotor body 9*d*. The advancing branch-out passage 33 is communicated to the advancing oil chamber 83, the advancing branch-out passage 34 is communicated to the advancing oil chamber 84 and the advancing branch-out passage 35 is communicated to the advancing oil chamber 85.

A journal portion 42 of the camshaft 2 is rotatably supported by a bearing portion 41 provided in a cylinder head (not shown), and a movement of the camshaft 2 in an axial direction is restricted. The retarding oil passage 38 and the advancing oil passage 39 are respectively connected to the oil inlet passage 28 and the oil-passage bore 2*b* formed in the camshaft 2 via oil passages (not shown) formed in the bearing portion 41.

As shown in FIG. 1, a switching valve 49 has two ports on a side to an oil pan 45, one of which is connected to an oil-feed passage 47 for supplying pressurized working oil from an oil pump 46 and the other of which is connected to an oil-drain passage 48 for draining the working oil to the oil pan 45. The switching valve 49 has further two ports on a side to the valve timing control device 99, each of which is respectively connected to the retarding oil passage 38 and the advancing oil passage 39.

The switching valve 49 switches over from one of the following three operation modes to the other operation mode:

(a) an oil feeding mode 49*a* for the retarding operation, in which the oil-feed passage 47 is communicated to the retarding oil passage 38, while the oil-drain passage 48 is communicated to the advancing oil passage 39;

(b) an oil-feed stopping mode 49*b*, in which neither the oil-feed passage 47 nor the oil-drain passage 48 is communicated to the retarding or advancing oil passage 38 or 39; and (c) an oil feeding mode 49*c* for the advancing operation, in which the oil-feed passage 47 is communicated to the advancing oil passage 39, while the oil-drain passage 48 is communicated to the retarding oil passage 38.

According to the above structure, the working oil from the oil pump 46 can be selectively supplied by the switching operation of the switching valve 49 to either the retarding oil chambers 80, 81, and 82 and the oil chamber 23 or the advancing oil chambers 83, 84 and 85 and the oil chamber 24, or the supply of the working oil to the valve timing control device 99 is stopped by the switching valve 49.

An operation of the valve timing control valve 99 will be explained. Hereinafter, an operation of the valve timing control device 99 in the advancing direction is referred to as an advancing operation, while an operation of the valve timing control device 99 in the retarding direction is referred to as a retarding operation.

(I) As shown in FIG. 3, in an initial condition of operating the valve timing control device 99, that is, at an engine starting operation, no pressurized working oil from the oil pump 46 is supplied to any of the retarding oil chambers 80, 81 and 82 and any of the advancing oil chambers 83, 84 and 85. The vane rotor 9 is, therefore, located in the maximum retarded position.

As shown in FIG. 5, the stopper pin 70 is inserted into the recess 60 by the biasing force of the spring 72, so that the vane rotor 9 is fixed to the sprocket 1 by the stopper pin 70.

(II) In the advancing operation, the oil feeding mode 49*c* for the advancing operation is selected by the switching valve 49. The working oil from the oil pump 46 is supplied to the center oil passage 36 via the oil-feed passage 47, the advancing oil passage 39 and the oil inlet port 37. The working oil is then distributed from the center oil passage 36 to the respective advancing oil chambers 83, 84 and 85 via the advancing branch-out passages 33, 34 and 35. The working oil is also supplied to the oil chamber 24 via the clearance 26 that is defined between the fitting part 70*a* of the stopper pin 70 and the inner wall 62 of the recess 60 (see dashed line arrow direction in FIG. 8A).

Since the oil pressure in the oil chamber 24 is applied to the tip end face 70*b* of the stopper pin 70, the stopper pin 70 is pushed toward the bottom wall of the hole 71 against the biasing force of the spring 72, so that the rigid coupling between the vane rotor 9 and the sprocket 1 is released.

Since the oil pressure in the respective advancing oil chambers 83, 84 and 85 is applied to the side surface on the retarding side of the respective vane portions 9*a*, 9*b* and 9*c*, the vane rotor 9 is rotated in the advancing direction relative to the sprocket 1. And the vane rotor 9 is rotated to the maximum advanced position shown in FIG. 4.

As a result of the above operation, the valve timing of the camshaft 2 is advanced. The working oil in the retarding oil chambers 80, 81 and 82 is drained to the oil pan 45 via the annular passage portion 29, the oil inlet passage 28, the retarding oil passage 38 and the oil-drain passage 48.

As shown in FIGS. 5 and 6, each of the vane portions 9*a*, 9*b* and 9*c* is moved from a position of FIG. 5 to a position of FIG. 6 in accordance with the rotation of the vane rotor 9 relative to the sprocket 1. During this operation, the advancing oil chamber 85 (83, 84) is relatively high in the oil pressure, while the retarding oil chamber 82 (80, 81) is relatively low in the oil pressure.

Since the oil-passage aperture 53 of the sealing plate 50 is formed at such position communicating with the advancing oil chamber 83, 84, 85 without being covered by the vane portion 9*a*, 9*b*, 9*c*, the working oil of the advancing oil chamber 83, 84, 85 flows into the pressure chamber 86 via the oil-passage aperture 53, as indicated by a dotted line L in FIGS. 5 and 6.

Since the oil pressure in the pressure chamber 86 is higher than that in the retarding oil chamber 80, 81, 82, which is located on the opposite side of the resiliently projected portion 55, the pressure difference is generated between the front side and the back side of the resiliently projected portion 55. As a result, the resiliently projected portion 55 is strongly pressed to the vane portion 9*a*, 9*b*, 9*c*. Accordingly, the sealing effect for the internal leakage between the advancing oil chambers 83, 84 and 85 and the retarding oil chambers 80, 81 and 82 can be obtained.

(III) In the retarding operation, the oil feeding mode 49*a* for the retarding operation is selected by the switching valve 49. The working oil from the oil pump 46 is supplied to the annular oil-passage portion 29 via the oil-feed passage 47, the retarding oil passage 38 and the oil inlet passage 28. The working oil is then distributed from the annular oil-passage portion 29 to the respective retarding oil chambers 80, 81, 82 via the retarding branch-out passages 30, 31 and 32. The working oil is also supplied to the oil chamber 23 via a communication passage 25.

Since the oil pressure in the oil chamber 23 is applied to a front-side side surface of the pressure receiving groove, the stopper pin 70 is pushed toward the bottom wall of the hole 71 against the biasing force of the spring 72. As a result, the stopper pin 70 is substantially moved out of the recess 60, in other words, a condition in which the coupling between the vane rotor 9 and the sprocket 1 is released is maintained.

Since the oil pressure in the respective retarding oil chambers 80, 81 and 82 is applied to the side surface on the advancing side of the respective vane portions 9*a*, 9*b* and 9*c*, the vane rotor 9 is rotated in the retarding direction relative to the sprocket 1. And the vane rotor 9 is rotated to the maximum retarded position shown in FIG. 3.

As a result of the above operation, the valve timing of the camshaft 2 is retarded. The working oil in the advancing oil chambers 83, 84 and 85 is drained to the oil pan 45 via the center oil passage 36, the oil inlet port 37, the advancing oil passage 39 and the oil-drain passage 48.

Even in this operation, the working oil introduced into the pressure chamber 86 from the advancing oil chambers 83, 84 and 85 is maintained. Therefore, in the same manner to the advancing operation, the pressure difference is generated between the front side and the back side of the resiliently projected portion 55, so that the resiliently projected portion 55 is pressed to the vane portion 9*a*, 9*b*, 9*c*. Accordingly, the sealing effect for the internal leakage can be obtained.

(IV) When the oil-feed stopping mode 49*b* of the switching valve 49 is selected during the advancing or retarding operation, that is, during the rotation of the vane rotor 9 relative to the sprocket 1, the supply of the working oil into the advancing or retarding oil chambers 83, 84, 85 and 80, 81, 82 as well as the drain of the working oil from the advancing or retarding oil chambers 83, 84, 85 and 80, 81, 82 is shut off, so that the vane rotor 9 is held at an intermediate position so as to realize a desired valve timing.

In the above operations (I) to (IV), the resiliently projected portion 55 of the sealing plate 50 is in contact with the vane portion 9*a*, 9*b*, 9*c* by the elastic force. In addition, the pressure difference between the pressure chamber 86 and the retarding oil chambers 80, 81 and 82 can be used. As a result, the sealing effect for the internal leakage of the working oil between the advancing oil chambers 83, 84 and 85 and the retarding oil chambers 80, 81 and 82 can be increased.

Now, advantages of the valve timing control device according to the first embodiment will be explained.

The recess 60 of the sealing plate 50 is configured to fit with the stopper pin 70. A valve timing control device of a comparison example will be described with reference to FIG. 8B. In the comparison example, a stopper ring 74 is provided in a bush hole 1*d* of a sprocket 1. An inner wall of the stopper ring 74 is formed into a tapered shape, and a fitting part 70*a* of the stopper pin 70 is fitted with the stopper ring 74. The stopper ring 74 causes an increase in the manufacturing cost, and the number of assembling processes is increased for assembling the stopper ring 74 to the sprocket 1. In contrast, according to the first embodiment, the stopper ring 74 is unnecessary, so that the number of components and the number of manufacturing processes are decreased.

The outer wall 61 of the recess 60 is fitted with the accommodation hole 1*b* of the sprocket 1, so that the recess 60 is supported by the sprocket 1 so as to secure the rigidity able to withstand for the fitting of the stopper pin 70. For example, it is especially effective in the case where the thickness of the sealing plate 50 becomes thin when the recess 60 is formed by deep-drawing.

Further, the positioning can be easily determined between the sealing plate 50 and the sprocket 1.

The projection 64, to which the tip end face 70*b* of the stopper pin 70 contacts, is formed on the bottom wall 63 of the recess 60. Therefore, the tip end face 70*b* of the stopper pin 70 is restricted from adhering on the bottom wall 63 of the recess 60. Further, the oil chamber 24 can be secured to have the predetermined height so as to correspond to the height of the projection 64. Thus, as shown in a dashed arrow direction S of FIG. 8A, the working oil is supplied to the oil chamber 24 through the clearance 26, so that the oil pressure is applied to the tip end face 70*b* of the stopper pin 70. Accordingly, the stopper pin 70 can have smooth movement.

The sealing plate 50 has the Rockwell hardness (HRc) of 50 or more as measured by the C-scale. Therefore, wearing of the sealing plate 50 caused by the sliding with the vane rotor 9 and wearing of the sealing plate 50 caused by the fitting with the stopper pin 70 can be restricted.

Second Embodiment

Figure 9:
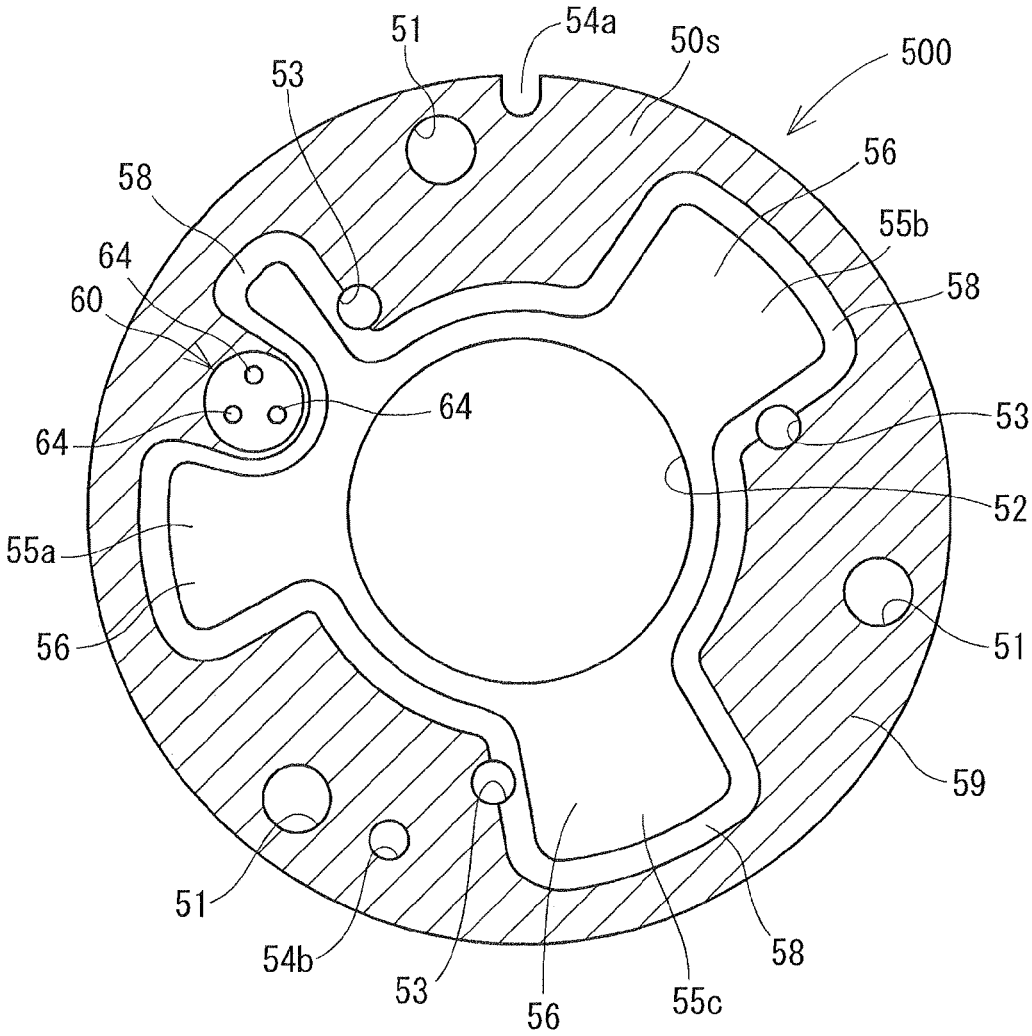
FIG. 9 is a schematic plan view showing a sealing plate of a valve timing control device according to a second embodiment of the present invention.

As shown in FIG. 9, a sealing plate 500 of a second embodiment is produced by applying a sealing material 50*s* on the surface of the base part 59 of the sealing plate 50 of the first embodiment. The sealing material 50*s* may be made of nitrile-butadiene rubber (NBR), liquid gasket, molybdenum disulfide coated member or foamed rubber, for example. When the sealing material 50*s* is applied to the base part 59, in addition to the effect obtained in the first embodiment, the sealing property can be improved on the supporting face of the sealing plate, and the working oil can be more effectively prevented from leaking outside. The sealing material 50*s* is applied to a face of the base part 59 opposing to the shoe housing 3 or a face of the base part 59 opposing to the sprocket 1, or is applied to both faces of the base part 59 opposing to the shoe housing 3 and the sprocket 1, respectively.

Other Embodiments

The valve timing control device can be applied not only to the intake valve 90 but also to the exhaust valve 93. In this case, the camshaft 92 of the exhaust valve 93 corresponds to the driven shaft. A phase control, which is reversed from the above embodiments, is carried out for the exhaust valve. In other words, the initial position corresponds to the maximum advanced position, while the maximum operated position corresponds to the maximum retarded position. The oil passage aperture is formed in the sealing plate so as to communicate the pressure chamber to the retarding oil chamber. Further, the recess of the sealing plate is formed at a position corresponding to the stopper pin at the most advanced position, and the stopper pin is fitted to the recess at the most advanced position.

Figure 8A:
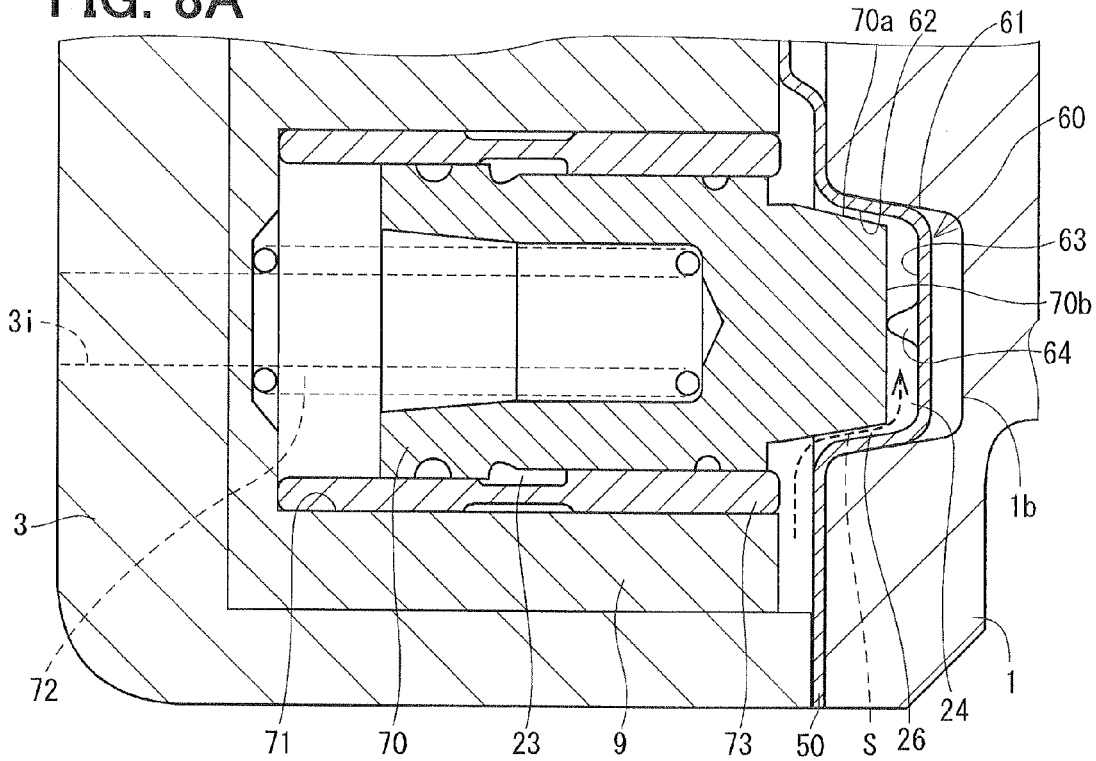
FIG. 8A is a schematic enlarged cross-sectional view showing a relevant portion VIIIA in FIG. 1.
Figure 8B:
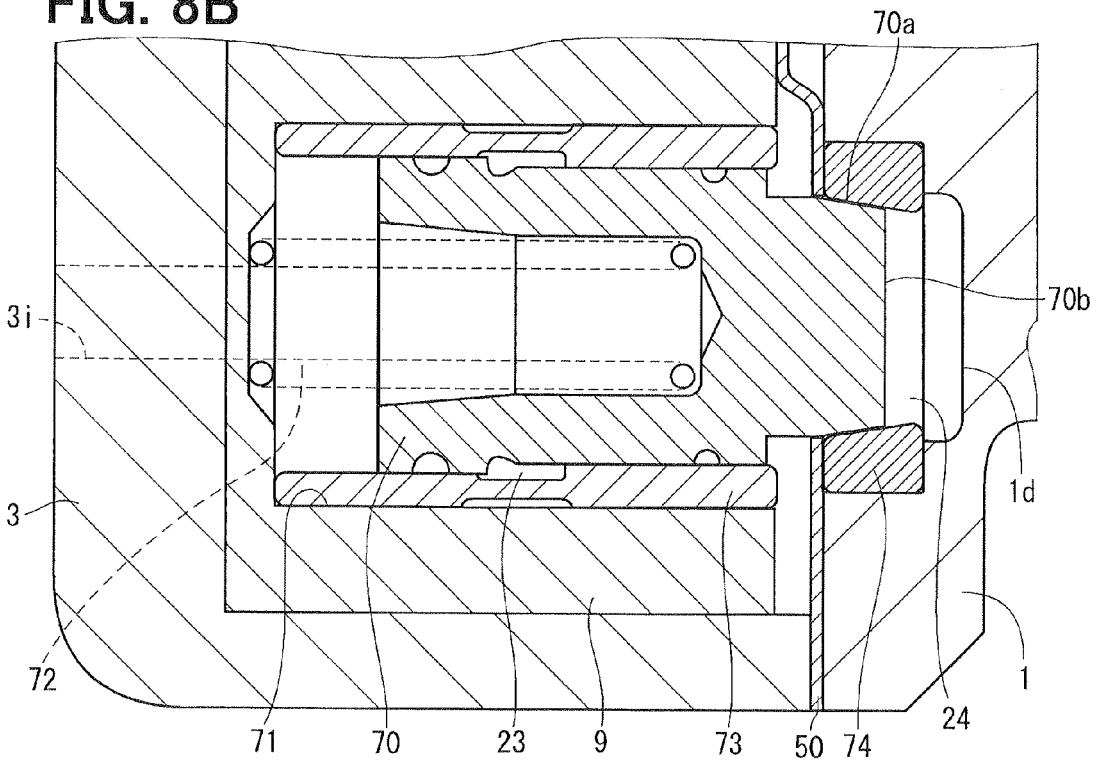
FIG. 8B is a schematic enlarged cross-sectional view showing a comparison example corresponding to the relevant portion VIIIA.

The outer wall 61 of the recess 60 has the tapered shape with a taper angle of about 10-15°, as shown in FIGS. 1 and 8A. Alternatively, the outer wall of the recess may be formed to be approximately perpendicular to the face of the base part of the sealing plate.

The number of the projections of the recess 60 is not limited to three. Further, the shape of the projection is not limited to the circle. For example, the bottom wall of the recess may be formed into a folded shape instead of the projections. Alternatively, the projection may be omitted when the stopper pin can be restricted from adhering by changing the material of the sealing plate or by performing the surface treatment to the sealing plate.

The recess 60 is fitted with the accommodation hole 1*b* of the sprocket 1, thereby the recess 60 is backed up by the sprocket 1 so as to obtain the rigidity, further, the positioning of the sealing plate 50 is performed relative to the sprocket 1. Alternatively, the accommodation hole 1*b* may be omitted if the rigidity can be obtained by the recess 60 itself and if the other positioning member can be used.

The hardness of the sealing plate 50, especially, the hardness of the recess 60 is considered in view of the hardness of the stopper pin 70, the collision load, the operation frequency and the withstand ages. For example, when the above conditions are comparatively loose, the sealing plate is not limited to have the Rockwell hardness of 50 or more as measured by the C-scale.

The shape of the oil-passage aperture 53 is not limited to the round shape, and may be an elongated shape. Further, two or more oil-passage apertures may be provided for the single of the advancing oil chamber or the retarding oil chamber.

According to the above embodiments, the shoe portions 3*a*, 3*b* and 3*c* as well as the vane portions 9*a*, 9*b* and 9*c* are provided at three positions. The number of the shoe portions and vane portions should not be limited to three.

The second housing is not limited to the sprocket 1, and may a pulley-type gear, to which the driving force is transmitted via a timing belt from the crankshaft 97.

The rotational shaft for the vane rotor 9 should not be limited to the camshaft 2, 92, which is the driven shaft operated by the engine 96. The rotational shaft for the vane rotor 9 may be the crankshaft 97, which is the driving shaft.

As above, the present invention should not be limited to the above embodiments but may be modified in various manners without departing from the spirit of the invention.

What is claimed is:

1. A valve timing control device that controls a valve opening/closing timing of at least one of an intake valve and an exhaust valve of an engine by changing a phase between a driving shaft of the engine and a driven shaft driven by the driving shaft so as to open/close the intake valve and the exhaust valve, the valve timing control device comprising:

a cup-shaped first housing rotated together with one of the driving shaft and the driven shaft, the first housing having an opening in an end face in an axis direction of the one of the driving shaft and the driven shaft;

a vane rotor accommodated in the first housing and rotated together with the other of the driving shaft and the driven shaft, the vane rotor having multiple vane portions rotatable relative to the first housing within a predetermined angular range, multiple advancing oil chambers being formed at one side of the respective vane portion in a rotational direction thereof, multiple retarding oil chambers being formed at the other side of the respective vane portion in the rotational direction thereof;

a second housing fixed to the first housing so as to close the opening of the first housing;

a sealing plate interposed between the first housing and the second housing, the sealing plate having a resiliently projected portion that is elastically deformable in a thickness direction and in contact with an end face of the vane rotor;

a regulating portion reciprocably accommodated in an accommodation hole opened in the vane rotor so as to oppose to the sealing plate; and a biasing portion that biases the regulating portion toward the sealing plate, wherein the sealing plate has a recess recessed toward the second housing and opened to the vane rotor at a predetermined position corresponding to the regulating portion in the relative rotation of the vane rotor, and the regulating portion regulates the relative rotation of the vane rotor relative to the first housing and the second housing by being fitted with the recess of the sealing plate.

2. The valve timing control device according to claim 1, wherein the second housing has a fitting hole at a position corresponding to the recess of the sealing plate, and the recess of the sealing plate has an outer wall fitted with the fitting hole of the second housing.

3. The valve timing control device according to claim 1, wherein the sealing plate has a projection at a bottom wall of the recess, the projection projects toward the vane rotor, and a tip end face of the regulating portion is able to contact the projection.

4. The valve timing control device according to claim 1, wherein the sealing plate has a Rockwell hardness of 50 or more as measured by a C-scale.

5. The valve timing control device according to claim 1, wherein the sealing plate has a base part outside of the resiliently projected portion in a radial direction, the base part of the sealing plate is interposed between the first housing and the second housing, and a sealing material is applied to at least one of a face of the base part opposing to the first housing and a face of the base part opposing to the second housing so as to raise oil-tightness property.

* * * * *